US011590407B2

(12) United States Patent
Boren et al.

(10) Patent No.: US 11,590,407 B2
(45) Date of Patent: Feb. 28, 2023

(54) EXPANDABLE SNOWSHOE ATTACHMENT FOR SNOWBOARD BINDINGS

(71) Applicant: Powder Soles, LLC, Cottonwood Heights, UT (US)

(72) Inventors: Jayson Boren, Cottonwood Heights, UT (US); Nelson Tate Floyd, Layton, UT (US)

( * ) Notice: Subject to any disclaimer, the term of this patent is extended or adjusted under 35 U.S.C. 154(b) by 0 days.

(21) Appl. No.: 17/204,810

(22) Filed: Mar. 17, 2021

(65) Prior Publication Data

US 2021/0291034 A1 Sep. 23, 2021

Related U.S. Application Data

(60) Provisional application No. 62/992,099, filed on Mar. 19, 2020.

(51) Int. Cl.
*A63C 10/14* (2012.01)
*A63C 13/00* (2006.01)

(52) U.S. Cl.
CPC ..... *A63C 10/14* (2013.01); *A63C 13/001* (2013.01); *A63C 2203/54* (2013.01)

(58) Field of Classification Search
CPC ..... A63C 13/001; A63C 10/00; A63C 10/14; A63C 10/28; A63C 13/003; A63C 13/005; A63C 5/00; A63C 2203/54
See application file for complete search history.

(56) References Cited

U.S. PATENT DOCUMENTS 5,884,933 A 3/1999 Trott
6,112,436 A * 9/2000 Quellais ..... A43C 15/09 36/125
8,348,299 B2 * 1/2013 Ekberg ..... A63C 13/006 280/600
9,884,243 B2 * 2/2018 Wariakois ..... A63C 10/14
2013/0229000 A1 * 9/2013 Ekberg ..... A63C 13/005 280/614
2018/0304142 A1 * 10/2018 Swaynie ..... A63C 13/001
2020/0391097 A1 * 12/2020 Grady ..... A63C 10/18

OTHER PUBLICATIONS

"Powder Soles, LLC" (Boren) Online retrieved from the Internet on May 24, 2021 httpl://www.youtube.com/watch?v=pr6RISUW2G4>, Jan. 29, 2020 (Jan. 29, 2020) entire document, especially 0:08-0:09, 1:11, 1:16, 1:19.
International Search Report and Written Opinion dated Jun. 8, 2022, on application No. PCT/US21/22966.

* cited by examiner

*Primary Examiner* — Brian L Swenson
(74) *Attorney, Agent, or Firm* — Lowenstein Sandler LLP

(57) ABSTRACT

A system for securing a snowboard binding to a snowboard may be an intermediary between the snowboard binding and the snowboard. In some embodiments, the system includes an expandable snowshoe attachment device. The system for securing a snowboard binding to a snowboard may include an upper piece and one or more lower pieces. The upper piece may be configured to attach to a lower surface of a baseplate of a snowboard binding. The one or more lower pieces may be rails. The rails may be fastened to a snowboard. The upper piece may include one or more extensions. The one or more extensions may deploy to increase a bottom surface area of the upper piece. Increasing the bottom surface area of the upper piece may increase the flotation of the upper piece on surfaces such as snow.

20 Claims, 7 Drawing Sheets

EXPANDABLE SNOWSHOE ATTACHMENT FOR SNOWBOARD BINDINGS

RELATED APPLICATIONS

This application claims the benefit of U.S. Provisional Application 62/992,099, filed Mar. 19, 2020, the entire contents of which are incorporated herein by reference.

TECHNICAL FIELD

This invention provides a user the functionality of a snowshoe while wearing snowboard bindings that secure the user to a snowboard. The invention further provides a quick-disconnect and rapid reconnect to the snowboard. The snowshoe function prevents the user from sinking in fresh or deep snow (i.e., "powder") while disconnected from the snowboard.

BACKGROUND

Snowboard riders often encounter situations where they must detach their boots from their snowboard. Often, these situations require the rider to walk through deep, powdery snow. This deep, powdery snow is difficult for a snowboard rider to walk through. Snowboarders who often travel off-piste in the backcountry frequently encounter deep, powdery snow. It is typical for such snowboarders to bring a set of snowshoes. Snowboarders must typically disconnect their boots from their snowboard bindings to use snowshoes. Snowshoes provide the necessary flotation for a user to walk on or near the top of deep powdery snow. A device that doubles as a part of a snowboard binding and a snowshoe would be advantageous to snowboard riders.

BRIEF DESCRIPTION OF THE DRAWINGS

The examples described herein will be understood more fully from the detailed description given below and from the accompanying drawings, which, however, should not be taken to limit the application to the specific examples, but are for explanation and understanding only.

DETAILED DESCRIPTION

Figure 1:
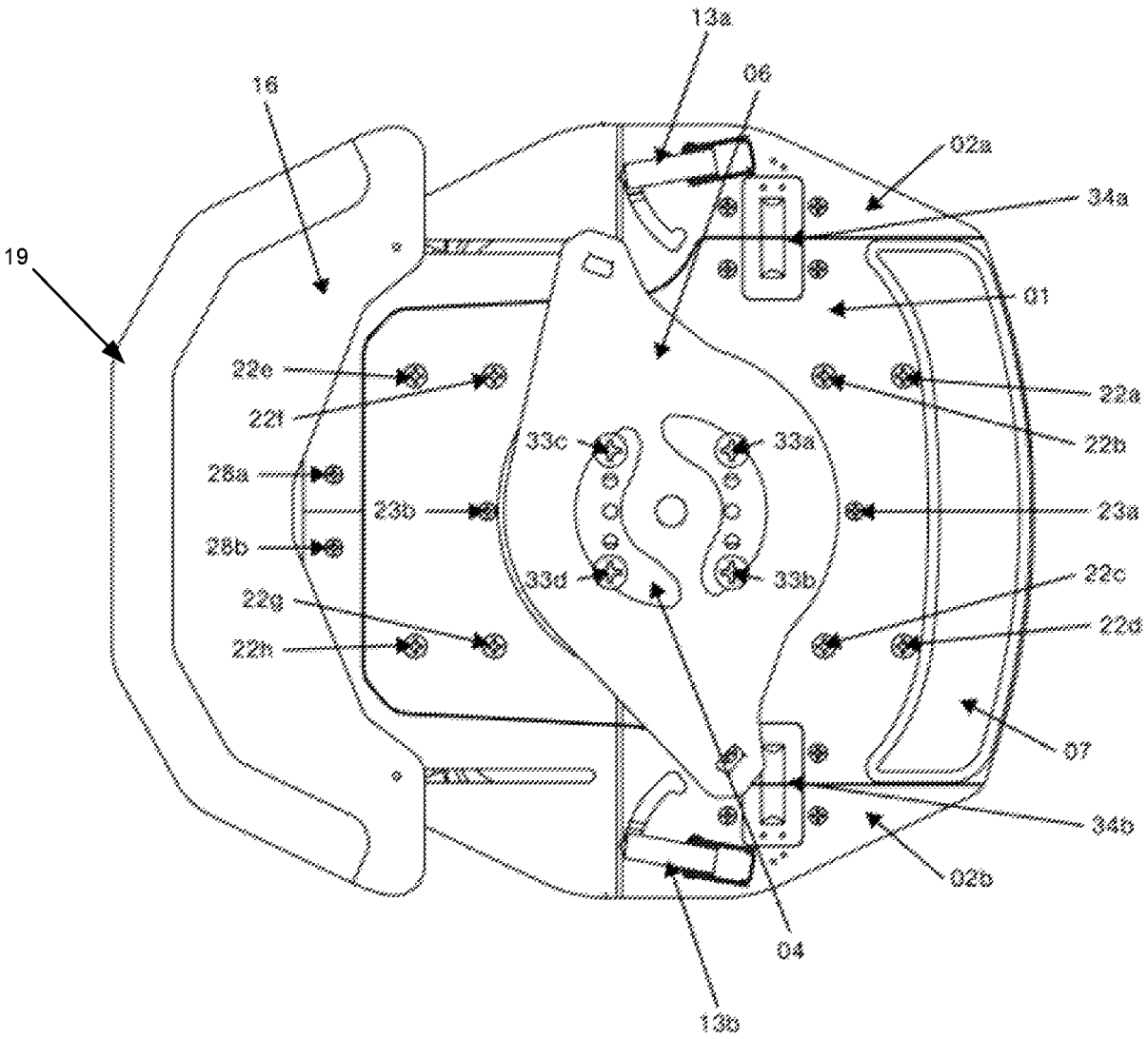
FIG. 1 is a schematic diagram illustrating a wireframe top view of an expandable snowshoe attachment device for snowboard bindings, according to certain embodiments.

Embodiments described herein are related to an expandable snowshoe attachment device for snowboard bindings.

Snowshoes are used to provide flotation to a user when walking across deep, powdery snow. Flotation is required so that a user does not sink deep into the snow. Without the aid of a pair of snowshoes, a person walking across deep, powdery snow will struggle, which may pose a danger of the person becoming stuck or exhausted. Cold winter ambient temperatures can then lead to hypothermia, frostbite, or death for a stranded person. Snowshoes allow a user to traverse snowy terrain easily and quickly.

Snowboard bindings secure a user's boot to a snowboard. A snowboard binding must be strong enough to hold the user's boot to the snowboard during demanding maneuvers, but must also be sufficiently light so as not to be a hindrance to the user and the user's riding experience. A snowboard binding must be easily secured and unsecured by the user. Snowboard bindings commonly use straps to secure a user's boot in the binding.

Snowboard bindings are often directly attached to a snowboard by way of multiple screws. A snowboard may have multiple holes in its top surface to receive multiple screws. A baseplate of a snowboard binding may also have multiple holes, through which screws may be threaded, and into the receiving holes of the snowboard. Tightening the screws may securely fasten the snowboard binding to the snowboard. A snowboard binding may commonly be fastened to a snowboard by four screws.

Described herein is a system for securing a snowboard binding to a snowboard. The system for securing a snowboard binding to a snowboard may be an intermediary between the binding and the snowboard. In some embodiments, the system includes an expandable snowshoe attachment device. The expandable snowshoe attachment device may be a snowshoe apparatus.

The system for securing a snowboard binding to a snowboard may include an upper piece and one or more lower pieces. The upper piece may include holes configured to accept fasteners from the baseplate of the snowboard binding. The holes may be threaded and be configured to accept threaded fasteners. The upper piece may be configured to attach to a lower surface of a baseplate of a snowboard binding. One or more lower pieces of the system may attach to the upper surface of the snowboard. The one or more lower pieces may be rails. The one or more lower pieces may be fastened to the snowboard by fasteners. The one or more lower pieces may be fastened to the snowboard by threaded fasteners. The threaded fasteners may utilize the receiving holes that are conventionally included in the snowboard. The one or more lower pieces can be fastened to the snowboard by other fasteners, including nails or adhesives.

The upper piece may be configured to attach to the one or more lower pieces. The attachment of the upper piece to the one or more lower pieces may create a rigid connection between the snowboard binding and the snowboard. The rigid connection between the binding and the snowboard may allow the snowboard rider to have full control over the snowboard without the worry of a loose connection.

The upper piece may include one or more extensions. The one or more extensions may be located at the rear of the upper piece. The one or more extensions may be coupled to the upper piece. The one or more extensions may be substantially planar. The one or more extensions may be retained in a retracted state. The one or more extensions may deploy to increase a bottom surface area of the upper piece. The one or more extensions may slide in a rearward direction to deploy. The one or more extensions may deploy responsive to pressure from one or more springs. In some embodiments, the one or more extensions deploy responsive to pressure from a lever. The lever may be manually operated. The lever may also be spring-activated.

Increasing the bottom surface area of the upper piece may increase the flotation of the upper piece on surfaces such as soft snow. Increasing the flotation of the upper piece on surfaces such as soft snow may allow a user to walk across the soft surface without sinking as deep into the soft surface as he or she would if walking without the upper piece. The upper piece may be used as a snowshoe when it is disconnected from the one or more lower pieces without the need for the user to disconnect his or her boot from the snowboard binding.

In some embodiments, the upper piece may be made up of two or more portions. The upper piece may include an inner portion and an outer portion. In some embodiments, the outer portion comprises two halves which are fastened together. The inner portion and the outer portion may be joined by a pivoting joint. The pivoting joint may pivot on a lateral axis of the upper piece. In some embodiments, the user's snowboard binding is attached to the inner portion of the upper piece. The pivoting joint may allow a user whose snowboard binding is attached to the upper piece to walk with a more natural motion while using the upper piece as a snowshoe. When the user lifts their foot and steps forward, the pivoting joint may allow the rear of the outer portion to pivot downward due to gravity. When the user lowers their foot to the surface he or she is walking on, the outer portion may pivot on the pivoting joint to come into the same plane as the inner portion. In some embodiments, the one or more extensions are attached to the outer portion of the upper piece.

In some embodiments, the user's snowboard binding may be fastened to a disk. The disk may be rotatably attached to an upper surface of the inner portion of the upper piece. The disk may rotate about a vertical axis relative to the inner portion of the upper piece. The disk may lock and unlock so that its rotational position can be held or adjusted. The disk may rotate so that the user can adjust the angle of the user's feet relative to the snowboard. This adjustment may be called the "riding stance." Upon unlocking, the disk may rotate to an angular position which places the user's foot and snowboard binding in-line with a central longitudinal axis of the upper piece. The disk rotating to a center angle may allow a user's foot to be in-line with the direction of travel while walking with the upper piece attached to the user's snowboard binding.

The upper piece and the one or more lower pieces may be made of aluminum. In some embodiments, the upper piece and the one or more lower pieces are made of plastic. In some embodiments, components of the upper piece and the one or more lower pieces are machined from 6061 aluminum. In some embodiments, components of the upper piece and the one or more lower pieces are machined from 7075 aluminum. In some embodiments, components of the upper piece and the one or more lower pieces are cast or stamped. In some embodiments, components of the system are made from stainless steel. Fasteners and other hardware of the system may be of stainless steel construction. In some embodiments, the fasteners and other hardware of the system are made of nickel-plated stainless steel.

The surfaces of the upper piece and the one or more lower pieces may have a coating. In some embodiments, the coating is an anodizing coating. The surfaces of the upper piece and the one or more lower pieces may be anodized. In some embodiments, the upper piece and the one or more lower pieces are powder coated. In some embodiments, a hydrophobic coating is applied to the upper piece and the one or more lower pieces of the system. The hydrophobic coating may prevent ice and snow accumulation on the system.

FIG. 1 is a schematic diagram illustrating a wireframe top view of an expandable snowshoe attachment device for snowboard bindings, according to certain embodiments. The expandable snowshoe attachment device for snowboard bindings may be an upper piece of a system for securing a snowboard binding to a snowboard. In some embodiments, the expandable snowshoe attachment device is a snowshoe. In some embodiments, the expandable snowshoe attachment device connects a user's snowboard binding to one or attachment points of a snowboard. In some embodiments, the expandable snowshoe attachment device serves dual roles, the first role being to act as a snowshoe, the second role being to connect a snowboard binding to one or more attachment points of a snowboard. A user may use a pair of expandable snowshoe attachment devices to secure their snowboard bindings to a snowboard (i.e., one device for each snowboard binding).

The expandable snowshoe attachment device may comprise an inner housing 01 and an outer housing. The outer housing may include left outer housing 02*a* and right outer housing 02*b*. The inner housing 01 may be an inner section or an inner portion of an expandable snowshoe attachment device. The left outer housing 02*a* and right outer housing 02*b* may comprise an outer section or an outer portion of an expandable snowshoe attachment device. In some embodiments, the left outer housing 02*a* and the right outer housing 02*b* are joined by walking pivot stop 17 (see FIG. 5). The left outer housing 02*a* and the right outer housing 02*b* may be joined by fasteners. Walking pivot stop 17 may be attached to each of the left outer housing 02*a* and the right outer housing 02*b* by one or more fasteners. The fasteners may be threaded. In some embodiments, the fasteners are screws. The screws may be outer housing to walking pivot stop screws 28*a* and 28*b*.

The inner housing 01 may act as a central body of the device. In some embodiments, the inner housing 01 is substantially planar. The inner housing 01 may have a thickness. The inner housing 01 may be substantially flat. The inner housing 01 may serve as the body to which the other components of the device attach. In some embodiments, the inner housing 01 may have a length similar to its width. The width of the inner housing 01 may be wider than the width of the baseplate of a standard snowboard binding. In some embodiments, the inner housing 01 may be wider at its front than at its rear.

In some embodiments, the left outer housing 02*a* may be substantially planar. The right outer housing 02*b* may also be substantially planar. The left outer housing 02*a* and the right outer housing 02*b* may be substantially mirror images of each other. The left outer housing 02*a* and the right outer housing 02*b* may each have a thickness. The left outer housing 02*a* and the right outer housing 02*b* may substantially surround the inner housing 01. The left outer housing 02*a* and the right outer housing 02*b* may reside in substantially the same plane as the inner housing 01. In some embodiments, the left outer housing 02*a* and right outer housing 02*b* extend laterally from the inner housing 01. The left outer housing 02*a* and the right outer housing 02*b* may also extend rearwards from the inner housing 01. In some embodiments, the combination of the left outer housing 02*a* and the right outer housing 02*b* may have a 'horseshoe' shape. The left outer housing 02*a* and the right outer housing 02*b* may not extend forward of the front edge of the inner housing 01.

The left outer housing 02*a* may be joined to the right outer housing 02*b*. In some embodiments, the left outer housing 02*a* and the right outer housing 02*b* are joined by walking pivot stop 17. (See FIG. 5). Fasteners may be used to attach the walking pivot stop 17 to each of the left outer housing 02*a* and the right outer housing 02*b*. In some embodiments, the fasteners are screws. In this specific embodiment, the fasteners are walking pivot stop screws 28*a* and 28*b*. The walking pivot stop 17 may limit the pivoting range of the left outer housing 02*a* and right outer housing 02*b* relative to the inner housing 01. The walking pivot stop 17 may limit the left outer housing 02*a* and the right outer housing 02*b* from pivoting to an angle where the rear of the left outer housing 02*a* and the right outer housing 02*b* is higher than the rear of the inner housing 01. The planar resting position of the inner housing 01 is substantially parallel to the plane of a surface of the snowboard when the device is attached to the snowboard.

In some embodiments, a magnetic contact is included between a heel edge of the inner housing 01 and the walking pivot stop 17. The magnetic contact may aid in connecting the inner housing 01 to locking rails of a snowboard (i.e., locking rails 12*a* and 12*b* of FIG. 2) by preventing the inner housing 01 and the left outer housing 02*a* and the right outer housing 02*b* from pivoting in the way of the locking rails. In some embodiments, the magnetic contact is made of two magnets. In some embodiments, the two magnets are made of magnetic material. The two magnets may be made of a ferrous metal. The magnetic material may be finished with a rubber-coated, powder-coated, or zinc-plated neodymium rare earth magnet. In some embodiments, the magnetic contact is attached to the device by an adhesive. In some embodiments, the magnetic contact is attached by press-fitting at least a portion of the magnetic contact within a recessed pocket of the walking pivot stop 17.

Figure 4:
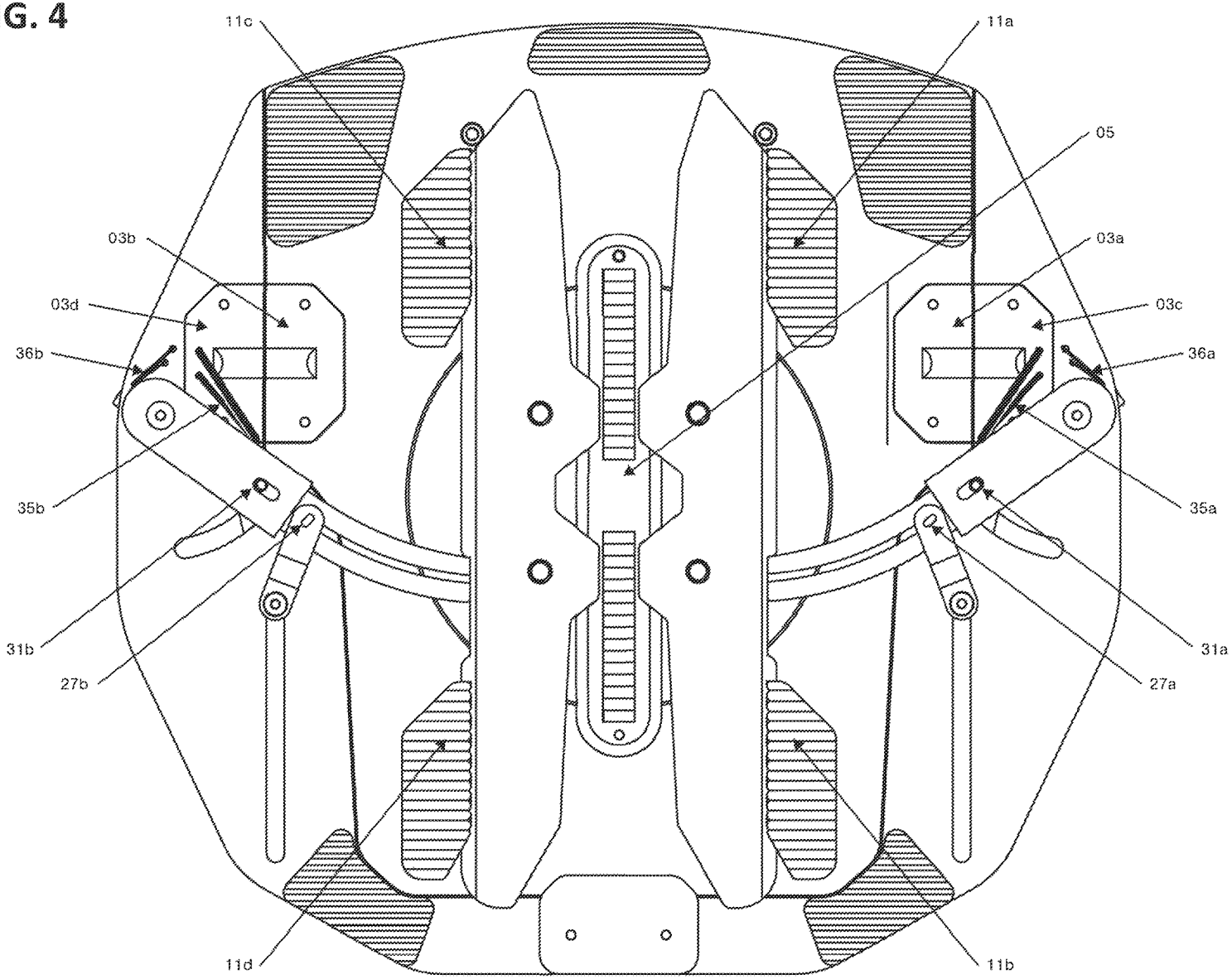
FIG. 4 is a schematic diagram illustrating a wireframe bottom view of an expandable snowshoe attachment device for snowboard bindings, according to certain embodiments.

The left outer housing 02*a* and the right outer housing 02*b* may be attached to the inner housing 01 via a pivoting joint. In some embodiments, the left outer housing 02*a* is attached to the inner housing 01 by way of pivoting dowel 34*a* and the right outer housing 02*b* is attached to the inner housing 01 by way of pivoting dowel 34*b*. The pivoting dowels 34*a* and 34*b* may create a pivoting joint between the inner housing 01 and the left outer housing 02*a* and right outer housing 02*b*. The pivoting joint between the inner housing 01 and the left outer housing 02*a* and right outer housing 02*b* may pivot about a lateral axis of the device. The pivoting dowels 34*a* and 34*b* may be retained by inner pivoting dowel brackets 03*a* and 03*b* and outer pivoting dowel brackets 03*c* and 03*d* (see FIG. 4). Inner pivoting dowel bracket 03*a* may be fastened to the inner housing 01 proximate a left side of the inner housing 01. Inner pivoting dowel bracket 03*b* may be fastened to the inner housing 01 proximate a right side of the inner housing 01. Outer pivoting dowel bracket 03*c* may be fastened to the left outer housing 02*a* on an inner side of the left outer housing 02*a*. Outer pivoting dowel bracket 03*d* may be fastened to the right outer housing 02*b* on an inner side of the right outer housing 02*b*. (See FIG. 4). In some embodiments, inner pivoting dowel brackets 03*a* and 03*b* and outer pivoting dowel brackets 03*c* and 03*d* are installed with a side having a smaller surface area facing an upward direction (see FIGS. 1 and 4). In other embodiments, inner pivoting dowel brackets 03*a* and 03*b* and outer pivoting dowel brackets 03*c* and 03*d* are installed with a side having a smaller surface area facing a downward direction (i.e., inverted from what is shown in FIGS. 1 and 4). A first end of each of the pivoting dowels 34*a* and 34*b* may fit in a recess in the inner housing 01. A second end of pivoting dowel 34*a* may fit in a recess in the left outer housing 02*a*. A second end of pivoting dowel 34*b* may fit in a recess in the right outer housing 02*b*. The pivoting dowel brackets 03*a* and 34*b* may cover the recesses in the inner housing 01. The pivoting dowel bracket 03*c* may cover a recess in the left outer housing 02*a*. The pivoting dowel bracket 03*d* may cover a recess in the right outer housing 02*b*. (See FIG. 4).

A disk may be mounted to a top surface of the inner housing 01. The disk may be pivoting disk 04. The pivoting disk 04 may be rotatably attached to a top surface of the inner housing 01. The pivoting disk 04 may be substantially planar. The pivoting disk 04 may have a thickness. The pivoting disk 04 may occupy a plane parallel to the plane of the inner housing 01. In some embodiments, the plane occupied by the pivoting disk 04 is adjacent to the plane of the inner housing 01. The pivoting disk 04 may be supported by the pivoting disk support 05 (see FIG. 4). The pivoting disk 04 may be rotatably attached to the pivoting disk support 05. The pivoting disk 04 may lock at a fixed position with the pivoting disk support 05 by a friction-locked contact when rotated to a center angle. The alignment of the pivoting disk 04 when rotated to a center angle may allow a user's foot to be in-line with the direction of travel while the user is walking. The pivoting disk support 05 may be attached to the inner housing 01 by one or more mechanical fasteners. In some embodiments, the pivoting disk support 05 is attached to the inner housing by the pivoting disk support screws 23*a* and 23*b*. The pivoting disk may be mounted to the approximate center of a top surface of the inner housing 01. In some embodiments, the pivoting disk 04 is substantially circular. The pivoting disk 04 may pivot about a vertical axis. The vertical axis may be approximately central to the pivoting disk 04.

In some embodiments, the pivoting disk 04 is a connection point for a user's snowboard binding. The pivoting disk 04 may accept a snowboard binding for attachment. The pivoting disk 04 may include holes for fasteners. In some embodiments, the holes are threaded. In some embodiments, the pivoting disk 04 includes four threaded holes. The holes of pivoting disk 04 may accept binding-to-disk screws 33*a*, 33*b*, 33*c*, and 33*d*. The binding-to-disk screws 33*a-d* may be fasteners. In some embodiments, the binding-to-disk screws 33*a-d* are threaded fasteners. The binding-to-disk screws may be screws. The binding-to-disk screws 33*a-d* may extend through a baseplate of a snowboard binding into receiving holes in the pivoting disk 04. The configuration of the threaded holes of the pivoting disk 04 may be a standard configuration commonly used by standard snowboard bindings.

In some embodiments, the pivoting disk 04 may include a stud on its upper surface. The stud may be an extruded stud. The stud may be fastened to the pivoting disk 04. A lock may be connected to the extruded stud. In some embodiments, the lock is the pivoting disk lock 06. The pivoting disk lock may comprise a center section with one or more radially extending arms. In some embodiments, the pivoting disk lock 06 is substantially planar. The pivoting disk lock 06 may have a thickness. The plane of the pivoting disk lock 06 may be parallel to the plane of the pivoting disk 04. The pivoting disk lock 06 may be secured to the pivoting disk 04 by fastening a snowboard binding. The snowboard binding may 'sandwich' the pivoting disk lock 06 onto the pivoting disk 04.

In some embodiments, pivoting disk lock 06 has ridges on a lower surface. The ridges on the lower surface of pivoting disk lock 06 may be locking teeth. The ridges on the lower surface of pivoting disk lock 06 may engage with ridges on an upper surface of pivoting disk 04. The ridges on the upper surface of the pivoting disk 04 may also be locking teeth. The ridges on both the upper surface of the pivoting disk 04 and the pivoting disk lock 06 may be situated circumferentially around the center of either the pivoting disk 04 or pivoting disk lock 06 respectively. In some embodiments, the ridges prevent the rotation of the pivoting disk 04 relative to the pivoting disk lock 06. A user may be able to set his or her "riding stance" by adjusting the rotational position of the pivoting disk 04 relative to the pivoting disk lock 06. The pivoting disk 04 may lock in one or more rotational positions.

The pivoting disk lock 06 may include one or more arms. In some embodiments, the pivoting disk lock 06 includes two arms. The arms of the pivoting disk lock 06 may extend radially from the center of the pivoting disk lock 06. The one or more arms of the pivoting disk lock 06 may extend towards the sides of the device. The arms of the pivoting disk lock 06 may extend past the side edges of the inner housing 01. The arms of the pivoting disk lock 06 may have slots in each arm. The slots may be recessed.

The slots of the arms of the pivoting disk lock 06 may engage locks. In some embodiments, the locks may be latches. In some embodiments, the latches are draw latches 13*a* and 13*b*. Draw latches 13*a* and 13*b* may latch the slots of the arms of the pivoting disk lock 06. The draw latch 13*a* may be attached to an upper surface of the left outer housing 02*a* by a fastener. The draw latch 13*b* may be attached to an upper surface of the right outer housing 02*b* by a fastener. In some embodiments, the draw latches 13*a* and 13*b* are attached to the left and right outer housing 02*a* and 02*b* respectively each by a rivet. The draw latches 13*a* and 13*b* may be attached to the left and right outer housing 02*a* and 02 *b* respectively each by a pin. In some embodiments, the draw latches 13*a* and 13*b* are each attached to the left and right outer housing 02*a* and 02*b* respectively at their outer ends.

The draw latches 13*a* and 13*b* may each include a downward curving lip. In some embodiments, the downward curving lip may engage a slot in an arm of the pivoting disk lock 06. When the device is in a closed and locked configuration, the downward curving lip of each of draw latches 13*a* and 13*b* may engage slots of the arms of the pivoting disk lock 06.

The draw latches 13*a* and 13*b* may be spring-loaded. In some embodiments, springs exert pressure on a latch of each of the draw latches 13*a* and 13*b*. The springs may exert pressure outwards on a latch of each of the draw latches 13*a* and 13*b*. The springs may be within each of the draw latches 13*a* and 13*b*. When the draw latches 13*a* and 13*b* are released, the springs inside each draw latch 13*a* and 13*b* may push on the downward curving lip of each draw latch 13*a* and 13*b* toward a position which disengages the draw latches 13*a* and 13*b* from the arms of the pivoting disk lock 06. The springs may be coil springs. The springs may be flat springs. The springs may be torsion springs.

The downward curving lip of each of the draw latches 13*a* and 13*b* may each engage a fastener. In some embodiments, the fasteners are the locking arm sliding fasteners 31*a* and 31*b*. (See FIG. 3). The locking arm sliding fasteners 31*a* and 31*b* may connect to locking arms of the device. The locking arms may be located on a bottom surface of left outer housing 02*a* and right outer housing 02*b*. In some embodiments, locking arm sliding fastener 31*a* connects to locking arm 09*a*, and the locking arm sliding fastener 31*b* connects to locking arm 09*b*. (See FIG. 5). The locking arm sliding fasteners 31*a* and 31*b* may follow a curved channel in the respective left outer housing 02*a* and right outer housing 02*b*. The channels may be "L" shaped. The channels may be concentric to a vertical axis about which each of the draw latches 13*a* and 13*b* pivots. The locking arm sliding fasteners 31*a* and 31*b* may be seated in a key-hole shaped end of each of the channels when the draw latches 13*a* and 13*b* engage their respective locking arm sliding fasteners 31*a* and 31*b*.

The locking arms 09*a* and 09*b* may include a spring. In some embodiments, the springs are locking arm springs 36*a* and 36*b*. (See FIG. 5). The locking arm springs 36*a* and 36*b* may contact an outer edge of each of the locking arms 09*a* and 09*b*. Each of the locking arm springs 36*a* and 36*b* may apply an inward force on its respective locking arm 09*a* and 09*b* which may disengage locking contact ends of each of the locking arms 09*a* and 09*b* from the locking rails 12*a* and 12*b* (See FIG. 2) when the draw latches 13*a* and 13*b* are disengaged. Locking arm springs 36*a* and 36*b* may be flat springs. In some embodiments, locking arm springs 36*a* and 36*b* are torsion springs. In other embodiments, locking arm springs 36*a* and 36*b* are coil springs.

In some embodiments, the draw latches 13*a* and 13*b* contact the locking arms 09*a* and 09*b* respectively when the draw latches are disengaged from the pivoting disk lock 06. The locking arms 09*a* and 09*b* may rotate in an outward direction dependent on the rotation of the draw latches 13*a* and 13*b*. The locking arms 09*a* and 09*b* may each rotate co-dependent with its respective draw latch 13*a* and 13*b*. The locking arms 09*a* and 09*b* may be free to slide towards a center-inside of each of locking arm guide 10*a* and 10*b* (See FIG. 5) when the draw latches 13*a* and 13*b* are disengaged from the locking arm sliding fasteners 31*a* and 31*b*.

Each locking arm 09*a* and 09*b* may include an extension bracket 08*a* and 08*b*. (See FIG. 5). Each extension bracket 08*a* and 08*b* may be secured in a channel of each locking arm 09*a* and 09*b*. The channel may be recessed. In some embodiments, each extension bracket 08*a* and 08*b* is secured in its respective channel by locking arm pins 27*a* and 27*b*. (See FIG. 4). In some embodiments, each extension bracket 08*a* and 08*b* is secured in it respective channel by two fasteners. The two fasteners may give more rigidity to each extension bracket 08*a* and 08*b*. The locking arms pins 27*a* and 27*b* may be fasteners. In some embodiments, locking arm pins 27*a* and 27*b* are rivets. A forward end of each extensions bracket 08*a* and 08*b* may slide freely in the channel of each respective locking arm 09*a* and 09*b*. An extruded pin of each of the extension brackets 08*a* and 08*b* may ride in the channel of each respective locking arm 09*a* and 09*b*. The extruded pin of each of the extensions brackets 08*a* and 08*b* may be located on a forward end of each of the extensions brackets 08*a* and 08*b*. The extruded pin of each of the extension brackets 08*a* and 08*b* may guide the movement of each extension bracket 08*a* and 08*b* relative to its respective locking arm 09*a* and 09*b*. A rear end of each extension bracket 08*a* and 08*b* may each fasten to their respective sliding plate support screws 30*a* and 30*b*. (See FIG. 5). Rearward movement of the extension brackets 08*a* and 08*b* may force the sliding plate 16 to extend rearward from the body of the device or deploy when the locking arms 09*a* and 09*b* are rotated in an outward direction. Forward movement of the extension brackets 08*a* and 08*b* may cause the sliding plate 16 to retract when the locking arms 09*a* and 09*b* are rotated in an inward direction.

The inner housing 01 may include a raised portion on its top surface proximate to its front edge. In some embodiments, this raised portion is inner housing lip 07. The inner housing lip may occupy approximately the front width of the inner housing 01. The inner housing lip 07 may extend rearward from the front edge of the inner housing 01. The inner housing lip 07 may be configured to support the toe of a baseplate of a snowboard binding. The inner housing lip 07 may provide support for the toe of a baseplate of a snowboard binding that is attached to the device. The inner housing lip 07 may be subjected to force from the toe of the baseplate of the snowboard binding by the user during snowboarding maneuvers. The inner housing lip 07 may provide stability to the toe of the baseplate of the snowboard binding. In some embodiments, the inner housing lip 07 is fastened to the inner housing 01 by stop screws 24*a* and 24*b*. (See FIG. 5).

The device may include one or more extensions. In some embodiments, the one or more extensions are primary extensions. In some embodiments, the device includes one or more secondary extensions. The one or more secondary extensions may extend from at least one primary extension. In some embodiments, the one or more extensions are plates. The one or more extensions may be coupled to the housing of the expandable snowshoe attachment device. The one or more extensions may extend from the main body of the device to increase a bottom surface area of the device. The one or more extensions may extend responsive to spring action. The one or more extensions may extend responsive to manual operation. In some embodiments, the one or more extensions extend responsive to manual operation with the assistance of spring action.

The increased bottom surface area of the device may allow the device to function as a snowshoe. In some embodiments, the device includes one extension. In other embodiments, the device includes two extensions. In some embodiments, the extension is sliding plate 16. When the one or more extensions are extended from the main body of the device, the device and the one or more extensions may be in a deployed state. In some embodiments, the one or more extensions extend from the main body of the device in a sliding manner. In some embodiments, the one or more extensions extend from the main body of the device in a rotating manner. The one or more extensions may rotate in a plane substantially parallel to a plane of the main body of the device. When the one or more extensions are in the deployed state, the expandable snowshoe attachment device may be configured to operate as a snowshoe. When the one or more extensions are retracted to the main body of the device, the device and the one or more extensions may be in a retracted state. In some embodiments, the device can be used as a snowshoe in the deployed state. In some embodiments, the device can secure a snowboard binding to a snowboard in the retracted state. In some embodiments, sliding plate 16 deploys by sliding rearward. In some embodiments, sliding plate 16 deploys in a rotational manner.

Sliding plate 16 may be substantially planar. Sliding plate 16 may have a thickness. Sliding plate 16 may attach to the right portion of the outer housing 02. The sliding plate 16 may be coupled to the left outer housing 02*a* and the right outer housing 02*b*. The sliding plate 16 may be attached to the left outer housing 02*a* and the right outer housing 02*b* by one or more fasteners. The one or more fasteners may be pins. The one or more fasteners may be screws. The one or more fasteners may extend through the thickness of the left outer housing 02*a* and right outer housing 02*b*. In some embodiments, the sliding plate 16 is attached to the left outer housing 02*a* by sliding plate support screw 30*a* and to the right outer housing 02*b* by sliding plate support screw 30*b*. In some embodiments, sliding plate support screws 30*a* and 30*b* are extruded studs of the sliding plate 16.

In some embodiments, the sliding plate 16 is supported by a pin that rides in one or more channels of an outer housing of the device. In some embodiments, the sliding plate 16 is supported by two pins each riding in an individual channel. In some embodiments, the sliding plate 16 is supported by four pins riding in two separate channels (i.e., two pins in each channel). Supporting the sliding plate 16 by four pins riding in two separate channels may provide more rigidity. The pins may be sliding plate support screws 30*a* and 30*b*. In some embodiments, the device includes four sliding plate support screws. In some embodiments, left outer housing 02*a* includes a channel and right outer housing 02*b* includes a channel (partially shown in FIG. 1; see also FIG. 5). The channels may be recessed. The channels may be parallel. The sliding plate support screws 30*a* and 30*b* may each ride in one of the channels. The sliding plate 16 may deploy responsive to the locking arms 09*a* and 09*b* rotating in an outward direction. Each of the locking arms 09*a* and 09*b* may contact and push a respective extension bracket 08*a* and 08*b*. The pushing of each extension bracket may also push each of the sliding plate support screws 30*a* and 30*b* as the locking arms 09*a* and 09*b* rotate. The pushing of the extension brackets 08*a* and 08*b* and further pushing of the sliding plate support screws 30*a* and 30*b* may deploy the sliding plate 16.

In some embodiments, the sliding plate 16 has a somewhat curved profile. The sliding plate 16 may have a rounded front, with the front of the sliding plate 16 being proximate to where the sliding plate 16 is attached to the left outer housing 02*a* and the right outer housing 02*b*. The width of the sliding plate 16 at its center may be a first width as measured in a longitudinal direction of the device. The sliding plate 16 may have a fairly constant width through its center section. The width of the sliding plate 16 may decrease towards its left and right ends. In some embodiments, the shape of the sliding plate 16 is such that the ends of the sliding plate 16 do not extend beyond the outer edges of the left outer housing 02*a* and right outer housing 02*b* when the sliding plate 16 is retracted (see FIGS. 6, 7).

In some embodiments, the sliding plate 16 deploys responsive to spring pressure. The sliding plate 16 may deploy responsive to spring action. The sliding plate 16 may be subject to spring pressure while retracted. The sliding plate 16 may be subject to spring pressure while deployed. The spring pressure the sliding plate 16 is subject to while deployed may be less than the spring pressure the sliding plate 16 is subject to while retracted.

The sliding plate 16 may include a raised portion on a top. The raised portion may be along a rear edge of the sliding plate 16. The raised portion may be a lip. In some embodiments, the raised portion is sliding plate lip 19. The sliding plate lip 19 may be an increased thickness of the sliding plate 16. The sliding plate lip 19 may extend inward from a rear edge of sliding plate 16. The sliding plate lip 19 may provide support for the heel of a baseplate of a snowboard binding that is attached to the device when the sliding plate 16 is in a retracted state. The sliding plate lip 19 may be configured to support a heel of a baseplate of a snowboard binding. The sliding plate lip 19 may be subjected to force from the heel of the baseplate of the snowboard binding by the user during snowboarding maneuvers when the sliding plate 16 is in a retracted state. The sliding plate lip 19 may provide stability to the heel of the baseplate of the snowboard binding when the sliding plate 16 is in a retracted state.

When extended, the sliding plate 16 may extend rearwards from the left outer housing 02*a* and the right outer housing 02*b*. The extension of the sliding plate 16 may increase a combined bottom surface area of the device, where the combined bottom surface area of the device includes a bottom surface area of the inner housing 01, a bottom surface area of the left outer housing 02*a*, a bottom surface area of the right outer housing 02*b*, and a bottom surface area of the sliding plate 16. Increasing the combined bottom surface area of the device may provide a user with increased flotation when using the device to walk on soft surfaces, such as snow. In some embodiments, it is the increased bottom surface area of the device that allows a user to use the device as a snowshoe.

Figure 6:
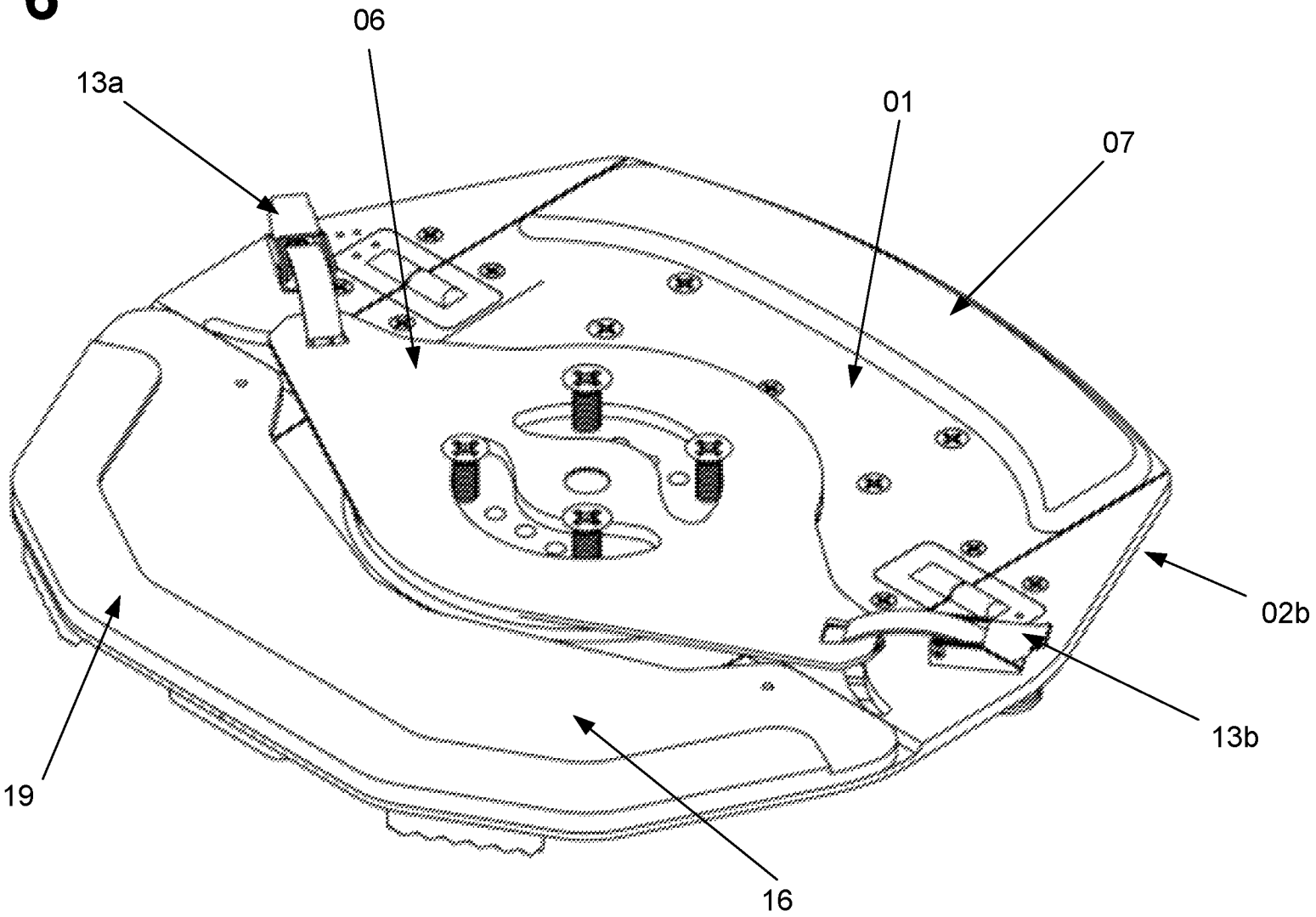
FIG. 6 is a schematic diagram illustrating a wireframe isometric view of an expandable snowshoe attachment device for snowboard bindings, according to certain embodiments.
Figure 7:
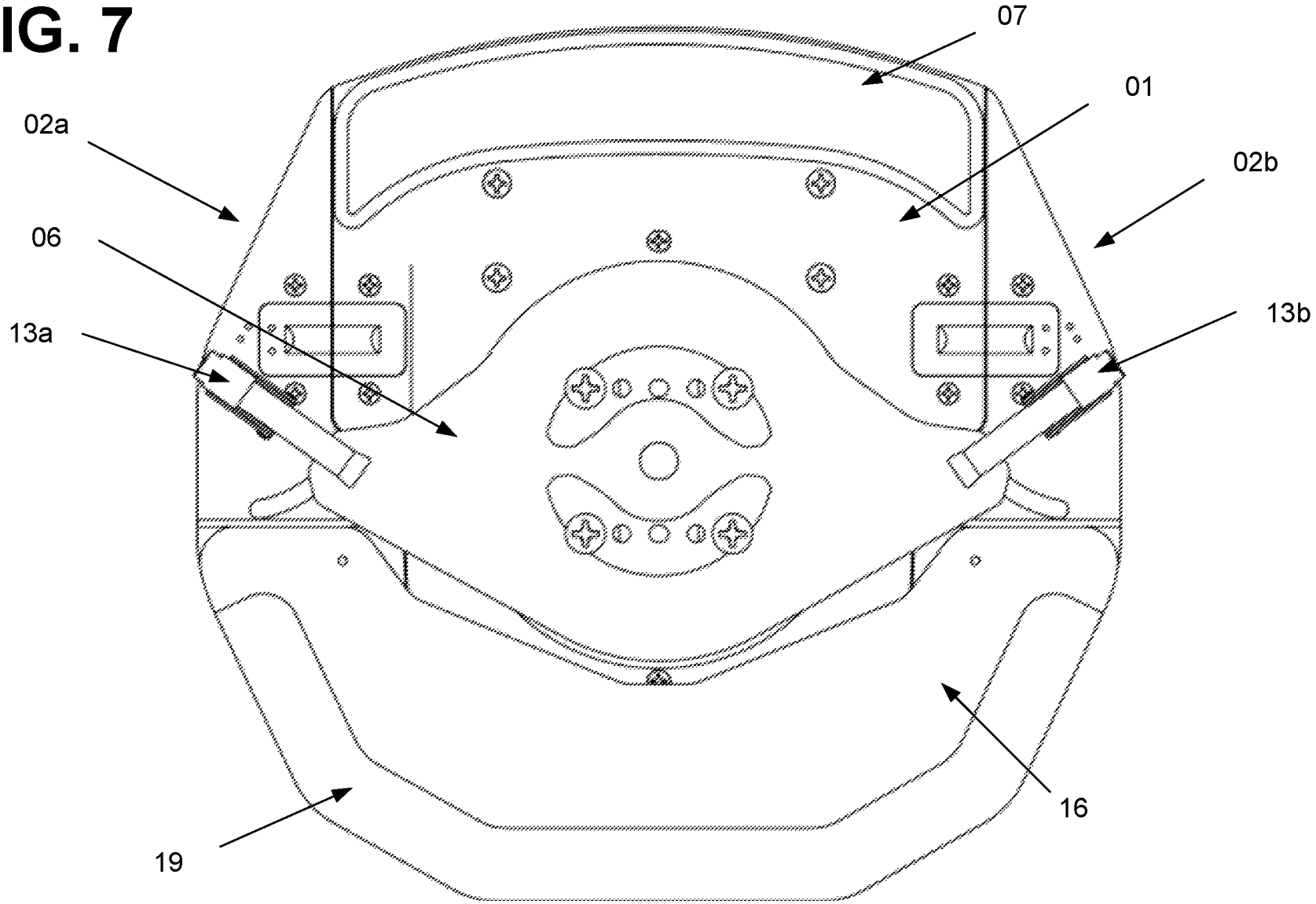
FIG. 7 is a schematic diagram illustrating a wireframe top view of an expandable snowshoe attachment device for snowboard bindings, according to certain embodiments.

When retracted, the sliding plate 16 may retract over the rear portions of the left outer housing 02*a*, the right outer housing 02*b*, and the inner housing 01 (see FIGS. 6, 7). When retracted, the sliding plate 16 may not extend beyond the outer edges of the left outer housing 02*a* and the right outer housing 02*b*.

In some embodiments, the inner housing 01 includes a plurality of holes for fasteners to pass through. Fasteners may pass through the inner housing 01 to attach components to the inner housing 01. Some holes in the inner housing 01 include holes for housing locking rail screws 22*a*, 22*b*, 22*c*, 22*d*, 22*e*, 22*f*, 22*g*, and 22*h*. The housing locking rail screws 22*a-h* may fasten housing locking rails 11*a*, 11*b*, 11*c*, and 11*d* to the bottom of the inner housing (see FIG. 4). The housing locking rail screws 22*a-h* may be fasteners. In some embodiments, the housing locking rail screws 22*a-h* are threaded fasteners. The housing locking rail screws 22*a-h* may be screws.

Figure 2:
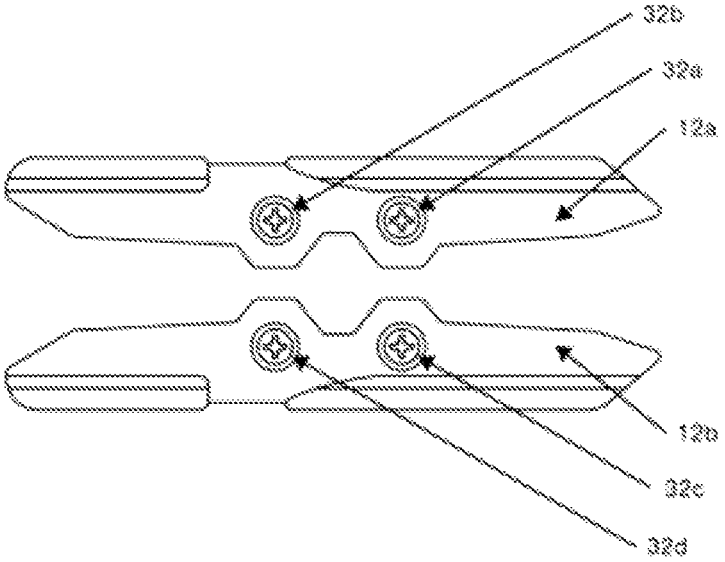
FIG. 2 is a schematic diagram illustrating a wireframe top view of locking rails of an expandable snowshoe attachment system for snowboard bindings, according to certain embodiments.

FIG. 2 is a schematic diagram illustrating a wireframe top view of locking rails of an expandable snowshoe attachment system for snowboard bindings, according to certain embodiments. The locking rails of an expandable snowshoe attachment system may be the lower pieces of a system for securing a snowboard binding to a snowboard. In some embodiments, the locking rails connect an upper piece of a system for securing a snowboard binding to a snowboard to a snowboard.

The locking rails of an expandable snowshoe attachment system may include locking rails 12*a* and 12*b*. The locking rails 12*a* and 12*b* may connect the inner housing 01 to a snowboard when the inner housing 01 mates to the locking rails 12*a* and 12*b*. In some embodiments, the locking rails 12*a* and 12*b* may be attached or otherwise fastened to the top surface of a snowboard. The locking rails 12*a* and 12*b* may each include holes for fasteners extending from their top surface to their bottom surface. The holes for fasteners in the locking rails 12*a* and 12*b* may be spaced to line up with holes typically included in the top surface of a snowboard for mounting bindings.

The locking rails 12*a* and 12*b* may be attached to the snowboard by fasteners. The locking rails 12*a* and 12*b* may be fastened to the snowboard by an adhesive. The locking rails 12*a* and 12*b* may be fastened to the snowboard by threaded fasteners. In some embodiments, the threaded fasteners are screws. The screws may be locking rail screws 32*a*, 32*b*, 32*c*, and 32*d*. Each locking rail may be fastened by two locking rail screws each. For example, locking rail 12*a* may be fastened by locking rail screws 32*a* and 32*b*, and locking rail 12*b* may be fastened by locking rail screws 32*c* and 32*d*. The locking rail screws 32*a-d* may thread into receiving holes in the top surface of the snowboard. The receiving holes in the top surface of the snowboard may be holes that are typically included on a standard snowboard for attaching traditional snowboard bindings. In some embodiments, the locking rails 12*a* and 12*b* may be fastened using different combinations of the holes in the top of the snowboard to mount the locking rails 12*a* and 12*b* toward the front or back of the snowboard.

Each of the locking rails 12*a* and 12*b* may substantially be mirror images of each other. The locking rails 12*a* and 12*b* may have fronts that are narrower than their bodies. The locking rails 12*a* and 12*b* may have substantially pointed fronts. In some embodiments, the points of the fronts of the locking rails 12*a* and 12*b* are rounded. The rears of the locking rails 12*a* and 12*b* may be tapered.

The locking rails 12*a* and 12*b* may include one or more slots in their side surfaces. In some embodiments, the one or more slots are configured to engage with one or more locking members. The one or more locking members may be locking members of the upper portion of the device. The one or more slots of the locking rails 12*a* and 12*b* may be configured to engage with locking arms 09*a* and 09*b* (see FIG. 4). In some embodiments, each locking rail 12*a* and 12*b* may be engaged by a single locking member. For example, locking rail 12*a* may engage with locking arm 09*a*, and locking rail 12*b* may engage with locking arm 09*b*. The locking members may engage the one or more slots of the locking rails 12*a* and 12*b* tightly to form a rigid connection between the upper portion of the device and the locking rails. In some embodiments, this tight engagement provides a rigid connection between the upper portion of the device and the snowboard.

The locking rails 12*a* and 12*b* may be mounted in pairs to one or more snowboards. Locking rails 12*a* and 12*b* mounted to a second or third or fourth (etc.) snowboard may be identical to the locking rails 12*a* and 12*b* mounted to the first snowboard. A user may be able to attach the expandable snowshoe attachment device to a pair of rails on multiple snowboards. In some embodiments, multiple pairs of locking rails 12*a* and 12*b* mounted to different snowboards allows user interchangeability. A user may be able to detach the expandable snowshoe attachment device from one snowboard and attach the device to another snowboard. A second user may then attach a second expandable snowshoe attachment device to the first snowboard.

Figure 3:
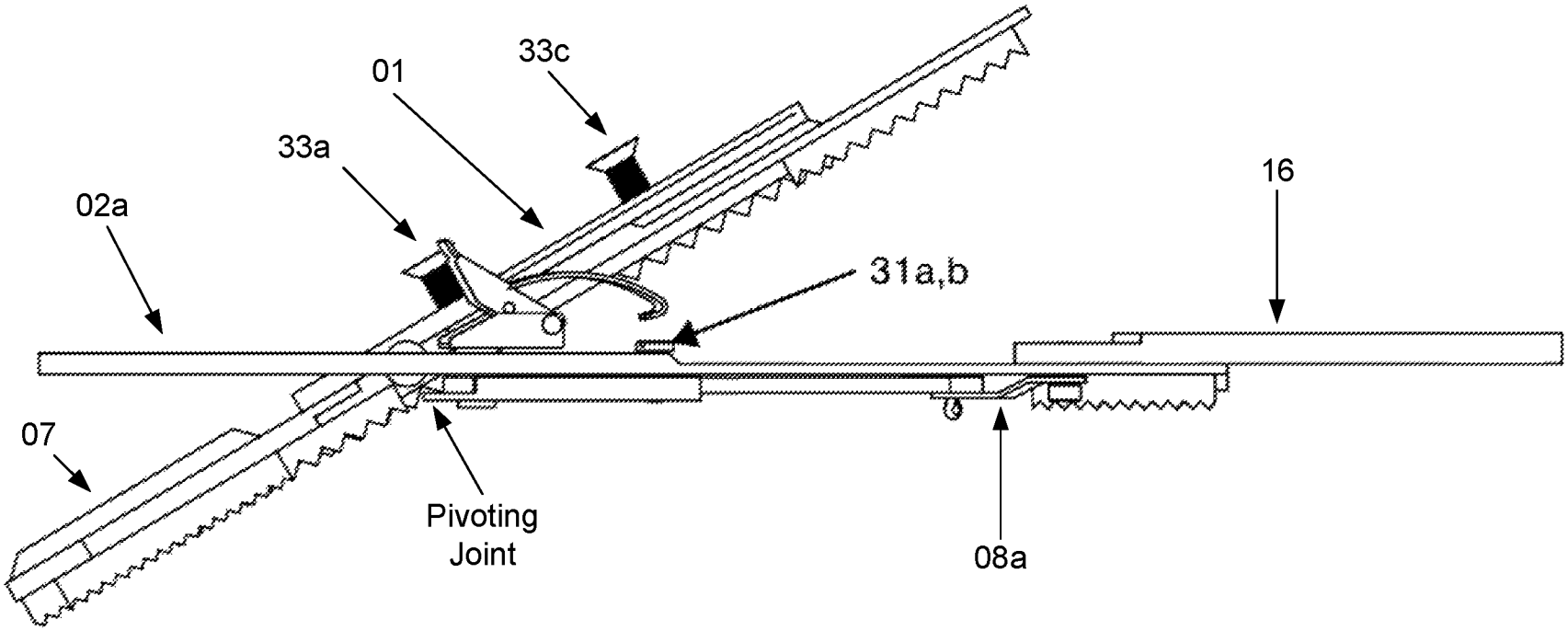
FIG. 3 is a schematic diagram illustrating a wireframe side view of an expandable snowshoe attachment device for snowboard bindings, according to certain embodiments.

FIG. 3 shows a schematic diagram illustrating a wireframe side view of an expandable snowshoe attachment device for snowboard bindings, according to certain embodiments.

The left outer housing 02*a* and the right outer housing 02*b* may be joined to the inner housing 01 by a pivoting joint. In some embodiments, the pivoting joint allows the inner housing 01 to pivot in relation to the left outer housing 02*a* and the right outer housing 02*b*. The pivoting of the pivoting joint may be along a lateral axis of the device. In some embodiments, the inner housing 01 may pivot relative to the left outer housing 02*a* and the right outer housing 02*b* when the device is in a state detached from a snowboard. The inner housing 01 may not pivot relative to the left outer housing 02*a* and the right outer housing 02*b* when the device is in a state attached to a snowboard. The pivoting may allow a user of the device to walk in a somewhat normal manner across a snowy or soft surface while the device is attached to the user's snowboard binding and boot.

In some embodiments, the pivoting of the inner housing 01 relative to the left outer housing 02*a* and the right outer housing 02*b* allows a user the flexibility of bending the user's knee and ankle while walking. In some embodiments, as the user lifts their foot, and thus the device also, the inner housing 01 remains in a plane roughly parallel to the plane of the bottom of the user's boot. The left outer housing 02*a* and the right outer housing 02*b* may pivot so that the rear of the left outer housing 02*a* and the rear of the right outer housing 02*b* falls below the plane of the inner housing 01. The deployed one or more extensions attached to the rear of the left outer housing 02*a* and the right outer housing 02*b* may touch the surface of the snow as the user lifts their foot. As the user moves their foot forward (i.e., takes a step), the deployed one or more extensions may drag across the surface of the snow. As the user lowers their foot, the left outer housing 02*a* and the right outer housing 02*b* may again become approximately coplanar with the inner housing 01. In some embodiments, the inner housing 01, left outer housing 02*a*, right outer housing 02*b*, and deployed one or more extensions bear the weight of the user as the user walks across a snowy or soft surface. In some embodiments, the pivoting action allows the device to behave like a snowshoe.

FIG. 4 is a schematic diagram illustrating a wireframe bottom view of an expandable snowshoe attachment device for snowboard bindings, according to certain embodiments. An expandable snowshoe attachment device may include dowel caps. In some embodiments, the dowel caps are brackets. In some embodiments, the dowel caps retain pivoting dowels 34*a* and 34*b*. The dowel caps may be inner pivoting dowel brackets 03*a* and 03*b*, and outer pivoting dowel brackets 03*c* and 03*d*. The inner pivoting dowel brackets 03*a*, and 03*b* may be fastened to a bottom surface of the inner housing 01. The outer pivoting dowel bracket 03*c* may be fastened to a bottom surface of the left outer housing 02*a*, and the outer pivoting dowel bracket 03*d* may be fastened to a bottom surface of the right outer housing 02*b*. In some embodiments, the inner and outer pivoting dowel brackets 03*a*, 03*b*, 03*c*, and 03*d* are be fastened by one or more mechanical fasteners.

In some embodiments, an expandable snowshoe attachment device includes a pivoting disk support 05. The pivoting disk support 05 may support the pivoting disk 04 (See FIG. 1). The pivoting disk support 05 may be attached to an underside of the inner housing 01. At least a portion of the pivoting disk support 05 may protrude through an opening of the inner housing 01 so that the pivoting disk 04 can be rotatably attached to a top surface of the pivoting disk support. In some embodiments, the pivoting disk support 05 is attached to the inner housing 01 by one or more mechanical fasteners. The pivoting disk support 05 may be attached to the inner housing 01 by way of the pivoting disk support screws 23*a* and 23*b* (See FIG. 1).

The underside of the pivoting disk support 05 may include traction-enhancing surfaces. The underside of the pivoting disk support 05 may include a corrugated surface. In some embodiments, the bottom surface of the pivoting disk support 05 includes ridges. The ridges on the bottom surface of the pivoting disk support 05 may aid the user of the device in gaining traction on slick surfaces. The corrugated surfaces may increase traction to the user. The corrugated surfaces may be configured to increase traction of the expandable snowshoe attachment device when operating as a snowshoe. In some embodiments, the pivoting disk support 05 includes crampons or a crampon extending from its bottom surface.

The pivoting disk support 05 may securely connect the pivoting disk 04 to the inner housing 01. In some embodiments, the pivoting disk support 05 includes one or more embossed grooves on its upper surface. One or more lower extruded studs of the pivoting disk 04 may lock into the one or more embossed grooves of the pivoting disk support 05. In some embodiments, the pivoting disk 04 can freely rotate relative to the pivoting disk support 05. In some embodiments, the rotational relationship of the pivoting disk 04 relative to the pivoting disk support 05 provides a user of the device the ability to adjust riding stance when the device is attached to a snowboard.

In some embodiments, an expandable snowshoe attachment device includes locking members. The locking members may be locking arms 09*a* and 09*b*. The locking arms 09*a* and 09*b* may substantially be mirror images of each other. The locking arms 09*a* and 09*b* may be attached to the bottom surface of the device. The locking arms 09*a* and 09*b* may be attached to the bottom surface of the device near an outside edge. In some embodiments, the locking arm 09*a* is attached to the left outer housing 02*a*, and the locking arm 09*b* is attached to the right outer housing 02*b*.

Figure 5:
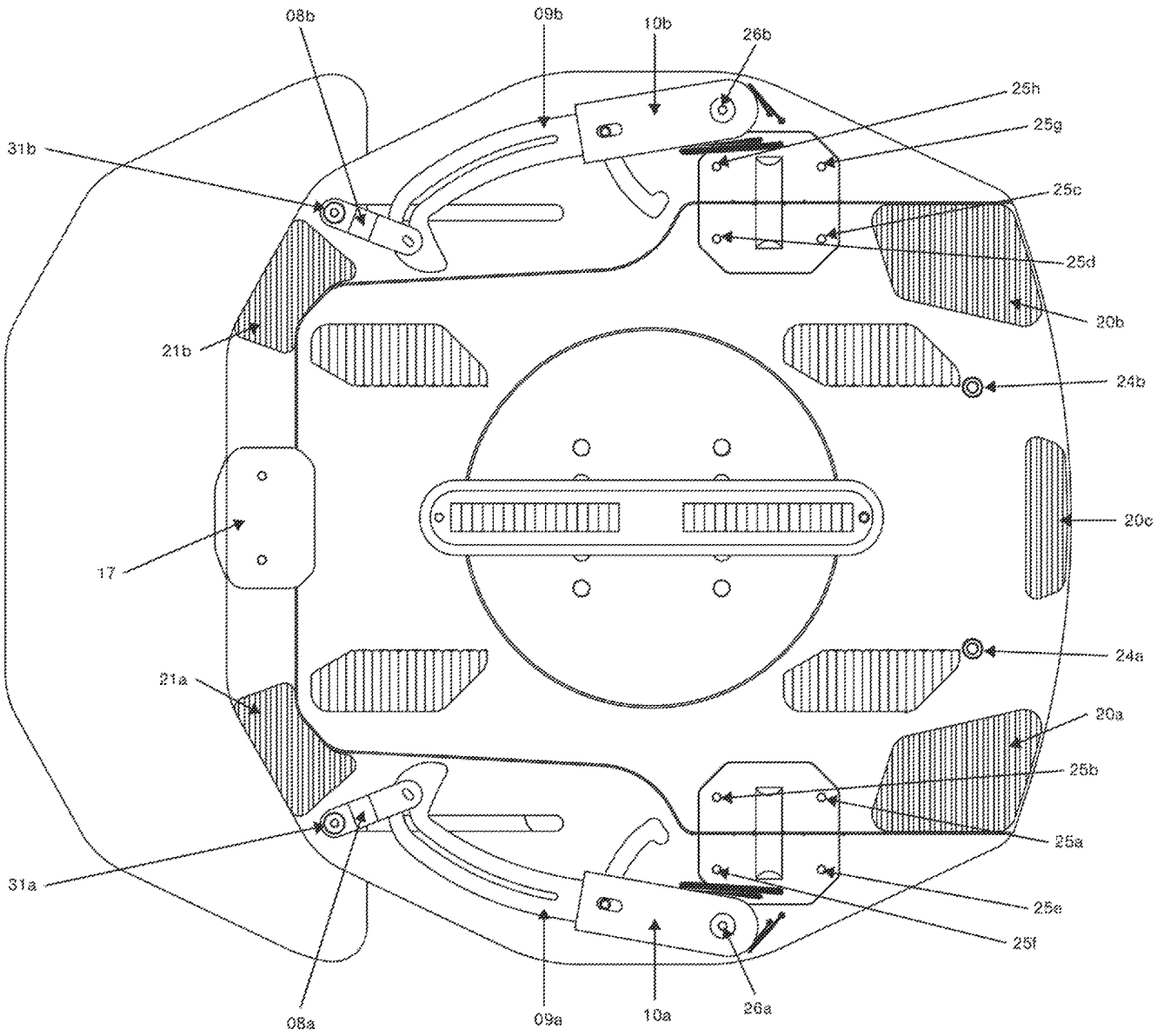
FIG. 5 is a schematic diagram illustrating a wireframe bottom view of an expandable snowshoe attachment device for snowboard bindings, according to certain embodiments.

The locking arms 09*a* and 09*b* may be attached to the draw latches 13*a* and 13*b* respectively by way of the locking arm screws 26*a* and 26*b* (see FIG. 5). The locking arm screw 26*a* may fasten locking arm 09*a* directly to draw latch 13*a*. Locking arm screw 26*b* may fasten locking arm 09*b* directly to draw latch 13*b*. In some embodiments, each locking arm 09*a* and 09*b* is fixed to its associated draw latch 13*a* and 13*b*. Each locking arm 09*a* and 09*b* may be fixed to its associated draw latch 13*a* and 13*b* by a fastener. A hole may exist in each of the left outer housing 02*a* and the right outer housing 02*b* for each of the locking arm screws 26*a* and 26*b* to pass through the left outer housing 02*a* and the right outer housing 02*b* from each of the locking arms 09*a* and 09*b* to their associated draw latch 13*a* and 13*b*. The locking arms 09*a* and 09*b* may be attached to the locking arm screws 26*a* and 26*b*, each at a first distal end.

The locking arms 09*a* and 09*b* may each have a second distal end. Each locking rail 09*a* and 09*b* may include a length between its first distal end and its second distal end. In some embodiments, each locking arm 09*a* and 09*b* is curved along its length. Each locking arm 09*a* and 09*b* may have a hook-shaped second distal end. The second distal end of each locking arm 09*a* and 09*b* may be a hook. The hook may be "L"-shaped (see FIG. 5). The "L" or hook of each of the second distal ends of the locking arms 09*a* and 09*b* may be oriented to point toward a central axis of the device.

The locking arms 09*a* and 09*b* may each pivot at their first distal ends. In some embodiments, the locking arms 09*a* and 09*b* pivot with each of the draw latches 13*a* and 13*b* to which they are attached. In some embodiments, each locking arm 09*a* and 09*b* pivots so that the second distal end of each locking arm 09*a* and 09*b* may engage one or more rails of a snowboard. The second distal end of each locking arm 09*a* and 09*b* may engage one or more slots in a rail. The second distal end of each locking arm 09*a* and 09*b* may engage a slot of one or more of the locking rails 12*a* and 12*b* (see FIG. 2). The second distal end of each locking arm 09*a* and 09*b* may hook one or more slots in the one or more rails. In some embodiments, the locking arms 09*a* and 09*b* pivot inwards toward a central axis of the device to engage the one or more rails. In some embodiments, the pivoting inwards of the locking arms 09*a* and 09*b* creates a tightening motion on the locking rails 12*a* and 12*b*. The locking arms 09*a* and 09*b* may be in an engaged state when engaging the one or more rails and in a disengaged or open state when not engaging the one or more rails. In some embodiments, the device can be removed from the snowboard when the locking arms 09*a* and 09*b* are in a disengaged state. The locking arms 09*a* and 09*b* may lock in the disengaged state until the device is placed in position for the locking arms 09*a* and 09*b* to engage the one or more rails. FIG. 4 may show the locking arms 09*a* and 09*b* in an engaged state. FIG. 5 may show the locking arms 09*a* and 09*b* in a disengaged or open state.

When the locking arms 09*a* and 09*b* are engaged with the one or more slots of the locking rails 12*a* and 12*b*, the device may be attached to a snowboard. In some embodiments, the device and the snowboard are in a connected state when the locking arms 09*a* and 09*b* are engaged with the one or more slots of the locking rails 12*a* and 12*b*. In some embodiments, the device and the snowboard are in a disconnected state when the locking arms 09*a* and 09*b* are disengaged from the one or more slots of the locking rails 12*a* and 12*b*. In some embodiments, the locking arms 09*a* and 09*b* disengage from the one or more slots of the locking rails 12*a* and 12*b* responsive to an at least partial rotation of the pivoting disk 04.

The locking arms 09*a* and 09*b* may each be guided by a guide. In some embodiments, each locking arm 09*a* and 09*b* is guided by a locking arm guide 10*a* and 10*b*. Each locking arm guide 10*a* and 10*b* may guide its respective locking arm 09*a* and 09*b* as the locking arms 09*a* and 09*b* pivot or slide. Locking arm guide 10*a* may guide locking arm 09*a*. Locking arm guide 10*b* may guide locking arm 09*b*. Each locking arm guide 10*a* and 10*b* may be attached to its associated locking arm 09*a* and 09*b*. In some embodiments, the locking arm guides 10*a* and 10*b* are attached to their associated locking arm 09*a* and 09*b* in a manner that allows for a minimal sliding motion relative to their associated locking arm 09*a* and 09*b*.

In some embodiments, each locking arm guide 10*a* and 10*b* partially encapsulates at least the first distal end of its associated locking arm 09*a* and 09*b*. Each locking arm guide 10*a* and 10*b* may be substantially "U" shaped. The locking arm guides 10*a* and 10*b* may cover a top surface and a bottom surface of each of the locking arms 09*a* and 09*b*. In some embodiments, the first distal end of each locking arm 09*a* and 09*b* sits in the middle of the "U" of its associated locking arm guide 10*a* and 10*b*.

Each locking arm guide 10*a* and 10*b* may be subject to spring pressure. In some embodiments, one or more springs exert force on each of the locking arm guides 10*a* and 10*b*. In some embodiments, the guide springs 35*a* and 35*b* exert force on the locking arm guides 10*a* and 10*b*. Guide spring 35*a* may exert a spring force on locking arm guide 10*a*. Guide spring 35*b* may exert a spring force on locking arm guide 10*b*. In some embodiments, the spring force exerted by the guide springs 35*a* and 35*b* on the locking arm guides 10*a* and 10*b* is transferred to the locking arms 09*a* and 09*b* through the locking arm guides 10*a* and 10*b*. The spring force exerted by the guide springs 35*a* and 35*b* may cause the locking arms 09*a* and 09*b* to be spring-loaded locking arms.

An expandable snowshoe attachment device for snowboard bindings may include one or more locking rails. The one or more locking rails may be attached to the main body of the device. The one or more locking rails may be attached to a housing of the device. In some embodiments, an expandable snowshoe attachment device includes housing locking rails 11*a*, 11*b*, 11*c*, and 11*d*. The housing locking rails 11*a-d* may provide connection points for one or more locking rails of a snowboard. In some embodiments, the housing locking rails 11*a-d* provide connection points for the locking rails 12*a* and 12*b* (see FIG. 2). The inner housing 01 may mate with the locking rails 12*a* and 12*b*. The inner housing 01 may connect to the snowboard when the inner housing 01 mates to the locking rails 12*a* and 12*b*. In some embodiments, the inner housing 01 mates with the locking rails 12*a* and 12*b* via the housing locking rails 11*a-d*. The locking rails 12*a* and 12*b* may mate with the housing locking rails 11*a-d*. In some embodiments, the expandable snowshoe attachment device slides over the locking rails 12*a* and 12*b* so that the locking rails 12*a* and 12*b* slide between the housing locking rails 11*a-d*. The housing locking rails 11*a-d* may fit tightly against the locking rails 12*a* and 12*b*. In some embodiments, the mating of the housing locking rails 11*a-d* with the locking rails 12*a* and 12*b* provides a secure connection of the device to the snowboard.

In some embodiments, to attach the device to a snowboard, the device must be slid in a rearward motion with the housing locking rails 11*a-d* in alignment with the locking rails 12*a* and 12*b* of the snowboard. The device may continue to slide rearward until one or more stops of the device contact the locking rails 12*a* and 12*b*. The one or more stops may be stop screws 24*a* and 24*b* (see FIG. 5). The device may lock to the locking rails 12*a* and 12*b* when or after the stop screws 24*a* and 24*b* contact the locking rails 12*a* and 12*b*. In some embodiments, to detach the device from a snowboard, after the device is unlocked from the locking rails 12*a* and 12*b*, the device must be slid in a forward motion until the housing locking rails 11*a-d* are free from the locking rails 12*a* and 12*b*.

The housing locking rails 11*a-d* may be attached to one or more bottom surfaces of the inner housing 01. In some embodiments, two of the housing locking rails 11*a* and 11*c* are attached substantially nearer the front of the device to a bottom surface of the inner housing 01. In some embodiments, two of the housing locking rails 11*b* and 11*d* are attached substantially nearer the rear of the device to a bottom surface of the inner housing 01. The housing locking rails 11*a* and 11*b* may be mirror images of the housing locking rails 11*c* and 11*d*. The housing locking rails 11*a-d* may each have at least one substantially straight side. The at least one substantially straight side of each housing locking rail 11*a-d* may make contact with one or more of the locking rails 12*a* and 12*b* when the device is attached to the locking rails 12*a* and 12*b*. The housing locking rails 11*a-d* may each have a curved front edge. The housing locking rails 11*a-d* may each have a chamfered rear edge. The housing locking rails 11*a-d* may each have a tapered rear edge. In some embodiments, the chamfered or tapered rear edge of each housing locking rail 11*a-d* aids in alignment of the housing locking rails 11*a-d* with the locking rails 12*a* and 12*b*.

The underside of each housing locking rail 11*a-d* may include traction-enhancing surfaces. In some embodiments, the bottom surface of each housing locking rail 11*a-d* includes ridges. The bottom surface of each housing locking rail 11*a-d* may be corrugated. The ridges on the bottom surface of each housing locking rail 11*a-d* may aid the user of the device in gaining traction on slick surfaces. The corrugated surfaces may increase traction to the user. In some embodiments, each housing locking rail 11*a-d* includes crampons or a crampon extending from its bottom surface.

FIG. 5 is a schematic diagram illustrating a wireframe bottom view of an expandable snowshoe attachment device for snowboard bindings, according to certain embodiments. FIG. 5 may show an expandable snowshoe attachment device as described above with sliding plate 16 in an extended or deployed state. The expandable snowshoe attachment device may be configured to operate as a snowshoe when the sliding plate 16 is in an extended or deployed state. FIG. 5 may also show an expandable snowshoe attachment device as described above with locking arms 09*a* and 09*b* in a position disengaged from locking rails 12*a* and 12*b*.

An expandable snowshoe attachment device may include foam on one or more bottom surfaces. In some embodiments, the foam on a bottom surface of the device provides shock absorption from forces exerted by the baseplate of the user's snowboard binding. The device may include front foam 20*a*, 20*b*, and 20*c*. The device may include rear foam 21*a* and 21*b*. In some embodiments, the front foam 20*a-c* provides shock absorption from the force exerted from the toe edge of the baseplate of the user's snowboard binding. In some embodiments, the rear foam 21*a* and 21*b* provides shock absorption from the force exerted from the heel edge of the baseplate of the user's snowboard binding. The front foam 21*a-c* and the rear foam 21*a* and 21*b* may be attached to one or more bottom surfaces of the device with adhesive. The front foam 21*a-c* and the rear foam 21*a* and 21*b* may be attached to one or more bottom surfaces of the device with one or more fasteners.

Front foam 20*a-c* may be attached along the front edge of the device on a bottom surface of the device. In some embodiments, front foam 20*a-c* is attached to a bottom surface of the inner housing 01 at or near the front edge of the inner housing 01. Front foam 20*a* may be attached at or near the left front corner of the inner housing 01. Front foam 20*c* may be attached at or near the right front corner of the inner housing 01. Front foam 20*a* and front foam 20*c* may be shaped as mirror images of each other. Front foam 20*b* may be attached at or near the center longitudinal axis of the device.

Rear foam 21*a* and 21*b* may be attached along the rear edge of the device on a bottom surface of the device. In some embodiments, rear foam 21*a* is attached to a bottom surface of left outer housing 02*a* at or near a rear edge of the left outer housing 02*a*, and rear foam 21*b* is attached to a bottom surface of the right outer housing 02*b* at or near the rear edge of the right outer housing 02*b*. Rear foam 21*a* may be attached at or near the left rear quadrant of the left outer housing 02*a*. Rear foam 21*b* may be attached at or near the right rear quadrant of the right outer housing 02*b*. Rear foam 21*a* and rear foam 21*b* may be shaped as mirror images of each other.

An expandable snowshoe attachment device may include stops. In some embodiments, the stops are stop screws 24*a* and 24*b*. Stop screws 24*a* and 24*b* may be threaded fasteners. Stop screws 24*a* and 24*b* may be threaded into holes in a bottom surface of the inner housing 01. In some embodiments, stop screws 24*a* and 24*b* are fasteners protruding from a bottom surface of the inner housing 01. In other embodiments, stop screws 24*a* and 24*b* are protruding members protruding from a bottom surface of the inner housing 01. The stop screws 24*a* and 24*b* may act as stops to stop the sliding motion of the expandable snowshoe attachment device as it is being slid into position to mate with the locking rails of a snowboard. In some embodiments, the stop screws 24*a* and 24*b* make contact with the locking rails of the snowboard when the device is in position to lock to the locking rails of the snowboard.

An expandable snowshoe attachment device may include pivoting dowel bracket screws 25*a*, 25*b*, 25*c*, 25*d*, 25*e*, 25*f*, 25*g*, and 25*h*. The pivoting dowel bracket screws 25*a-h* may fasten the inner and outer pivoting dowel brackets 03*a-d* to a bottom surface of the device. In some embodiments, the pivoting dowel bracket screws 25*a-d* fasten the inner pivoting dowel brackets 03*a* and 03*b* to a bottom surface of the inner housing 01, the pivoting dowel bracket screws 25*e* and 25*f* fasten the outer pivoting dowel bracket 03*c* to a bottom surface of the left outer housing 02*a*, and the pivoting dowel bracket screws 25*g* and 25*h* fasten the outer pivoting dowel bracket 03*d* to a bottom surface of the right outer housing 02*b* The pivoting dowel bracket screws 25*a-h* may be mechanical fasteners. In some embodiments, the pivoting dowel bracket screws 25*a-h* are threaded fasteners.

An expandable snowshoe attachment device may include locking arm screws 26*a* and 26*b*. Locking arm screws 26*a* and 26*b* may attach locking arms 09*a* and 09*b* to their associated draw latches 13*a* and 13*b*. Locking arm screws 26*a* and 26*b* may be mechanical fasteners. In some embodiments, locking arm screws 26*a* and 26*b* are threaded fasteners. Locking arms 09*a* and 09*b* each may be attached to their associated draw latch 13*a* and 13*b* by adhesive. Locking arms 09*a* and 09*b* each may be attached to their associated draw latch 13*a* and 13*b* by an interference fit.

An expandable snowshoe attachment device may include one or more support screws. The one or more support screws may support the one or more extensions of the device. In some embodiments, the one or more support screws support one or more plates that extend from the main body of the device. The one or more support screws may be sliding plate support screws 30*a* and 30*b*. Sliding plate support screws 30*a* and 30*b* may be mechanical fasteners. In some embodiments, the sliding plate support screws 30*a* and 30*b* are threaded fasteners. The sliding plate support screws 30*a* and 30*b* may be machine screws.

The sliding plate support screws 30*a*, and 30*b* may each individually ride in a channel in the body of the device. In some embodiments, the body of the device includes two channels. The channels may be parallel. In some embodiments, the channels are curved. The sliding plate support screw 30*a* may ride in a channel in the left rear quadrant of the left outer housing 02*a*. The sliding plate support screw 30*b* may ride in a channel in the right rear quadrant of the right outer housing 02*b*. The sliding plate support screws 30*a* and 30*b* may guide the sliding plate 16 as the sliding plate 16 extends and retract from the body of the device.

FIG. 6 is a schematic diagram illustrating a wireframe isometric view of an expandable snowshoe attachment device for snowboard bindings, according to certain embodiments. FIG. 6 may show an expandable snowshoe attachment device with an extension in a retracted position. Details not seen in one or more of the preceding figures may be shown in FIG. 6.

FIG. 7 is a schematic diagram illustrating a wireframe top view of an expandable snowshoe attachment device for snowboard bindings, according to certain embodiments. FIG. 7 may show an expandable snowshoe attachment device with an extension in a retracted position. Details not seen in one or more of the preceding figures may be shown in FIG. 7.

The above description of illustrated implementations of the disclosure, including what is described in the Abstract, is not intended to be exhaustive or to limit the disclosure to the precise forms disclosed. While specific implementations of, and examples for, the disclosure are described herein for illustrative purposes, various equivalent modifications are possible within the scope of the disclosure, as those skilled in the relevant art will recognize.

Various operations are described as multiple discrete operations, in turn, in a manner that is helpful in understanding the present disclosure, however, the order of description should not be construed to imply that these operations are necessarily order dependent. In particular, these operations need not be performed in the order of presentation.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

Various embodiments can have different combinations of the structural features described above. For instance, all optional features of a device or system described herein can also be implemented in a device or system and specifics in the examples can be used anywhere in one or more embodiments.

While the present disclosure has been described with respect to a limited number of embodiments, those skilled in the art will appreciate numerous modifications and variations therefrom. It is intended that the appended claims cover all such modifications and variations as fall within the true spirit and scope of this present disclosure.

In the description herein, numerous specific details are set forth, such as examples of specific types of material, specific sizes, specific surfaces, specific structures, specific details, specific configurations, specific types, specific system components, specific operations, etc. in order to provide a thorough understanding of the present disclosure. It will be apparent, however, to one skilled in the art that these specific details need not be employed to practice the present disclosure. In other instances, well known components or methods, such as specific and alternative material, sizes, surfaces, structures, details, configurations, types, system components, operations, etc. have not been described in detail in order to avoid unnecessarily obscuring the present disclosure.

Although some of the embodiments herein are described with reference to specific devices or systems, other embodiments are applicable to other types of structures and surfaces. Similar techniques and teachings of embodiments of the present disclosure can be applied to other types of structures and surfaces that can benefit from advantages described herein. In addition, the description herein provides examples, and the accompanying drawings show various examples for the purposes of illustration. However, these examples should not be construed in a limiting sense as they are merely intended to provide examples of embodiments of the present disclosure rather than to provide an exhaustive list of all possible implementations of embodiments of the present disclosure.

As used herein, the terms "substantially," "about," and/or the like, in some embodiments refer to a range of 2% greater and 2% less, in some embodiments refer to a range of 5% greater and 5% less, in some embodiments refer to a range of 10% greater and 10% less, in some embodiments refer to a range of 15% greater and 15% less, and in some embodiments refer to a range of 20% greater and 20% less, Use of the phrase 'configured to,' in one embodiment, refers to arranging, putting together, manufacturing, offering to sell, importing and/or designing an apparatus, hardware, logic, or element to perform a designated or determined task. In this example, an apparatus or element thereof that is not operating is still 'configured to' perform a designated task if it is designed, coupled, and/or interconnected to perform said designated task.

Furthermore, use of the phrases 'to,' 'capable of/to,' and or 'operable to,' in one embodiment, refers to some apparatus, hardware, and/or element designed in such a way to enable use of the apparatus, hardware, and/or element in a specified manner. Note that use of to, capable to, or operable to, in one embodiment, refers to the latent state of an apparatus, hardware, and/or element, where the apparatus, hardware, and/or element is not operating but is designed in such a manner to enable use of an apparatus in a specified manner.

Reference throughout this specification to "one embodiment," "an embodiment," or "some embodiments" means that a particular feature, structure, or characteristic described in connection with the embodiment is included in at least one embodiment of the present disclosure. Thus, the appearances of the phrases "in one embodiment," "in an embodiment," and "in some embodiments" in various places throughout this specification are not necessarily all referring to the same embodiment. Furthermore, the particular features, structures, or characteristics can be combined in any suitable manner in one or more embodiments.

In the foregoing specification, a detailed description has been given with reference to specific exemplary embodiments. It will, however, be evident that various modifications and changes can be made thereto without departing from the broader spirit and scope of the disclosure as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but can refer to different and distinct embodiments, as well as potentially the same embodiment.

The words "example" or "exemplary" are used herein to mean serving as an example, instance or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Also, the terms "first," "second," "third," "fourth," etc. as used herein are meant as labels to distinguish among different elements and can not necessarily have an ordinal meaning according to their numerical designation.

What is claimed is:

1. An expandable snowshoe attachment device configured to attach to a lower surface of a baseplate of a snowboard binding between the snowboard binding and a first snowboard.

2. The expandable snowshoe attachment device of claim 1, further comprising:

an inner housing;

an outer housing; and one or more plates attached to the outer housing, wherein the one or more plates are configured to increase a bottom surface area of the expandable snowshoe attachment device when deployed.

3. The expandable snowshoe attachment device of claim 1, further comprising a pivoting joint connecting an inner portion and an outer portion of the expandable snowshoe attachment device, wherein the pivoting joint is configured to:

pivot on a lateral axis of the expandable snowshoe attachment device;

lock in a first state, wherein the expandable snowshoe attachment device is connected to the first snowboard in the first state; and unlock in a second state, wherein the expandable snowshoe attachment device is disconnected from the first snowboard in the second state.

4. The expandable snowshoe attachment device of claim 1, further comprising:

a disk rotatably attached to a top surface of the expandable snowshoe attachment device, wherein the disk is configured to:

pivot on a vertical axis of the disk;

lock in one or more rotational positions, wherein the disk is locked by at least one or more latches;

unlock to allow rotation to another of the one or more rotational positions; and attach to the snowboard binding; and at least one raised portion on a top surface of the expandable snowshoe attachment device, wherein the at least one raised portion is configured to support a toe edge or a heel edge of the baseplate of the snowboard binding.

5. The expandable snowshoe attachment device of claim 1, wherein the expandable snowshoe attachment device is configured to:

connect to one or more rails of a snowboard;

secure the snowboard binding to the first snowboard by way of the one or more rails of the first snowboard while the expandable snowshoe attachment device is connected to the one or more rails of the first snowboard;

secure the snowboard binding to a second snowboard by way of first and second rails of the second snowboard while the expandable snowshoe attachment device is connected to the first and second rails of the second snowboard; and operate as a snowshoe while the expandable snowshoe attachment device is disconnected from the one or more rails of the first or second snowboard.

6. The expandable snowshoe attachment device of claim 1, further comprising one or more corrugated surfaces on one or more bottom surfaces of one or more components of the expandable snowshoe attachment device, wherein the one or more corrugated surfaces are configured to increase traction.

7. The expandable snowshoe attachment device of claim 1, further comprising:

a first locking arm attached to the expandable snowshoe attachment device by a first distal end; and a second locking arm attached to the expandable snowshoe attachment device by a first distal end;

wherein the first and second locking arms are configured to:

rotate at their respective first distal ends;

engage first and second rails of the first snowboard respectively with respective second distal ends in a first state, wherein the expandable snowshoe attachment device is connected to the first snowboard by way of the first and second rails of the first snowboard in the first state; and lock in a second state disengaged from the first and second rails of the first snowboard, wherein the expandable snowshoe attachment device is disconnected from the first snowboard in the second state.

8. A system for securing a snowboard binding to a first snowboard, the system comprising:

an inner housing;

an outer housing, wherein the outer housing is attached to the inner housing via a pivoting joint;

one or more plates attached to the outer housing, wherein the one or more plates are configured to increase a combined bottom surface area of the outer housing and the one or more plates when deployed; and a first rail and a second rail, wherein the first rail and the second rail are:

attached to the first snowboard; and configured to connect the inner housing to the first snowboard when the inner housing mates to the first rail and the second rail.

9. The system of claim 8, wherein the pivoting joint is configured to:

pivot on a lateral axis of the outer housing;

lock in a first state, wherein the inner housing is connected to the first snowboard in the first state; and unlock in a second state, wherein the inner housing is disconnected from the first snowboard in the second state.

10. The system of claim 8, further comprising:

a disk rotatably attached to a top surface of the inner housing, wherein the disk is configured to:

pivot on a vertical axis of the disk;

lock in one or more rotational positions, wherein the disk is locked by at least one or more latches;

unlock to allow rotation to another of the one or more rotational positions; and attach to the snowboard binding; and at least one raised portion on a top surface of the inner housing, wherein the at least one raised portion is configured to support a toe edge or a heel edge of a baseplate of the snowboard binding.

11. The system of claim 8, wherein:

the system is configured to secure the snowboard binding to the first snowboard by way of the first and second rails while the inner housing is connected to the first and second rails;

the inner housing is configured to secure the snowboard binding to a second snowboard by way of first and second rails of the second snowboard while the inner housing is connected to the first and second rails of the second snowboard; and at least a portion of the system is configured to operate as a snowshoe while the inner housing is disconnected from the first and second rails.

12. The system of claim 8, further comprising one or more corrugated surfaces on one or more bottom surfaces of one or more components of the inner housing, wherein the one or more corrugated surfaces are configured to increase traction.

13. The system of claim 8, further comprising:

a first locking arm attached to the inner housing by a first distal end; and a second locking arm attached to the inner housing by a first distal end;

wherein the first and second locking arms are configured to:

rotate at their respective first distal ends;

engage the first and second rails respectively with respective second distal ends of the first and second locking arms in a first state, wherein the inner housing is connected to the first snowboard by way of the first and second rails in the first state; and lock in a second state disengaged from the first and second rails, wherein the inner housing is disconnected from the first snowboard in the second state.

14. The system of claim 8, wherein:

the first and second rails each comprise one or more slots configured to accept locking members of the inner housing; and the first and second rails are oriented substantially parallel on a top surface of the first snowboard.

15. A snowshoe apparatus, comprising:

a housing;

one or more extensions coupled to the housing;

a retracted state, wherein the snowshoe apparatus in the retracted state is configured to connect and disconnect from a first snowboard; and a deployed state, wherein in the deployed state the snowshoe apparatus is configured to operate as a snowshoe, wherein the snowshoe apparatus is configured to attach to a lower surface of a baseplate of a snowboard binding.

16. The snowshoe apparatus of claim 15, wherein the housing comprises:

an inner section; and an outer section, wherein the one or more extensions are coupled to the outer section of the housing and are configured to increase a bottom surface area of the snowshoe apparatus when deployed.

17. The snowshoe apparatus of claim 15, further comprising a pivoting joint connecting an inner portion and an outer portion of the snowshoe apparatus, wherein the pivoting joint is configured to:

pivot on a lateral axis of the snowshoe apparatus;

lock in a first state, wherein the snowshoe apparatus is connected to the first snowboard in the first state; and unlock in a second state, wherein the snowshoe apparatus is disconnected from the first snowboard in the second state.

18. The snowshoe apparatus of claim 15, further comprising:

a disk rotatably attached to a top surface of the snowshoe apparatus, wherein the disk is configured to:

pivot on a vertical axis of the disk;

lock in one or more rotational positions, wherein the disk is locked by at least one or more latches;

unlock to allow rotation to another of the one or more rotational positions; and attach to a snowboard binding; and at least one raised portion on the top surface of the snowshoe apparatus, wherein the at least one raised portion is configured to support a toe edge or a heel edge of the baseplate of the snowboard binding.

19. The snowshoe apparatus of claim 15, wherein the snowshoe apparatus is configured to:

connect to one or more rails of the first snowboard;

secure a snowboard binding to the first snowboard by way of the one or more rails of the first snowboard while the snowshoe apparatus is connected to the one or more rails of the first snowboard;

secure the snowboard binding to a second snowboard by way of first and second rails of the second snowboard while the housing is connected to the first and second rails of the second snowboard; and operate as a snowshoe while the snowshoe apparatus is disconnected from the one or more rails of the first or second snowboard.

20. The snowshoe apparatus of claim 15, further comprising:

a first locking arm attached to the snowshoe apparatus by a first distal end; and a second locking arm attached to the snowshoe apparatus by a first distal end;

wherein the first and second locking arms are configured to:

rotate at their respective first distal ends;

engage first and second rails of the first snowboard respectively with respective second distal ends of the first and second locking arms in a first state, wherein the snowshoe apparatus is connected to the first snowboard by way of the first and second rails of the first snowboard in the first state; and lock in a second state disengaged from the first and second rails of the first snowboard, wherein the snowshoe apparatus is disconnected from the first snowboard in the second state.

* * * * *